US005894829A

United States Patent [19]

Schmid

[11] Patent Number: 5,894,829

[45] Date of Patent: Apr. 20, 1999

[54] METHOD FOR REGULATING THE FULL-LOAD INJECTION QUANTITY OF A DIESEL INTERNAL COMBUSTION ENGINE

[75] Inventor: Wolfram Schmid, Nuertingen, Germany

[73] Assignee: Daimler-Benz AG, Germany

[21] Appl. No.: 08/964,213

[22] Filed: Nov. 4, 1997

[30] Foreign Application Priority Data

Nov. 4, 1996 [DE] Germany ..... 196 45 389

[51] Int. Cl.[6] ..... F02M 37/04

[52] U.S. Cl. ..... 123/370

[58] Field of Search ..... 123/365, 367, 123/370, 388, 446, 357

[56] References Cited

U.S. PATENT DOCUMENTS

| | | | |
|---|---|---|---|
| 4,368,706 | 1/1983 | Yasuhara | 123/370 |
| 4,655,186 | 4/1987 | Takeda et al. . | |
| 5,174,259 | 12/1992 | Shinzawa | 123/357 |

FOREIGN PATENT DOCUMENTS

| | | |
|---|---|---|
| 26 50 247 | of 1978 | Germany . |
| 26 50 247 A1 | of 1978 | Germany . |
| 37 00 401 C2 | of 1989 | Germany . |
| WO 89/11027 | of 1989 | WIPO . |

*Primary Examiner*—Thomas N. Moulis
*Attorney, Agent, or Firm*—Evenson, McKeown, Edwards & Lenahan, P.L.L.C.

[57] ABSTRACT

A method for regulating the full-load injection quantity of a diesel internal combustion engine having a fixed steady state full-load injection quantity includes the following phases: a first transient phase, in which the full-load injection quantity is increased to a value which exceeds the steady state full-load injection quantity; a second time-limited phase, in which the full-load injection quantity is maintained at the excess level and, at the end of this phase, is reduced to the full-load injection quantity in the steady state; and a third phase, in which the full-load injection quantity in the steady state is supplied to the diesel internal combustion engine in a known way.

2 Claims, 2 Drawing Sheets

METHOD FOR REGULATING THE FULL-LOAD INJECTION QUANTITY OF A DIESEL INTERNAL COMBUSTION ENGINE

BACKGROUND AND SUMMARY OF THE INVENTION

This application claims the priority of German patent document 196 45 389.5, the disclosure of which is expressly incorporated by reference herein.

The invention relates to a method for regulating the full-load injection quantity of a diesel internal combustion engine.

German patent document DE-A-26 50 247 describes a method for limiting the maximum permissible fuel feel quantity of a diesel engine fuel pump equipped with a mechanical speed governor. In this case, for optimum utilization of engine power, a limited full-load feed quantity assigned to the respective engine speed is derived from a full-load feed quantity characteristic map. The air mass supplied to the engine serves as a second operating variable in addition to the engine speed. For supercharged diesel engines, the charge-air pressure is used as a second operating variable.

By virtue of the method described there, the engine is utilized up to the power limit even in the transient mode (which, in the case of internal combustion engines, represents the transition from a low load state to a higher load state), and the most favorable acceleration values can thereby be achieved.

This transient mode is subsequently followed by a uniform steady-state mode.

However, the measures taken in this method are highly complicated and, furthermore, cannot fully achieve their object of the optimum utilization of the diesel engine in the transient mode.

U.S. Pat. No. 4,655,186 discloses a method for controlling the injection quantity of an Otto internal combustion engine so as to avoid an excessively lean mixture under a high load. In Otto engines, the mixture becomes leaner as a physical consequence of the transient state which prevails during acceleration from a low load. When the mixture becomes leaner, the exhaust-gas temperature rises, which under some circumstances may damage the exhaust-gas catalyst.

According to the method described there, a larger quantity of fuel and therefore an over-enriched mixture is injected as a countermeasure to the mixture becoming leaner. The method can be used only in an Otto engine, since, in a diesel engine, different preconditions prevail with regard to thermodynamic equilibrium of the internal combustion engine. Furthermore, such method can be used only within very narrow limits, since ignitability is no longer ensured if the mixture is too highly enriched. Only a very slight power or torque increase (for better acceleration) can be achieved by means of the method described there.

German patent document DE 37 00 401 C2 describes a mixture-regulating device for the feedback regulation of the air/fuel ratio of an internal combustion engine which is normally operated with a lean mixture. In order to achieve a desired response behaviour, along with a low emission of $No_x$, even in transient states of the internal combustion engine, a control is provided such that the change in the air/fuel ratio temporarily exceeds an amount necessitated by the change in a desired value. Complicated mechanical devices are required for this purpose, however; and, they do not allow accurate control. Furthermore, a torque increase or power increase cannot be achieved by means of the device described there.

The object of the invention is to provide a method which improves the driving dynamics of a diesel internal combustion engine by simple means, without the need for accessories.

This object is achieved by the method according to the invention, in which operation of the diesel internal combustion engine is divided into three phases. Gas acceptance as well as torque, and consequently also driving dynamics in the transient mode, are considerably improved by adding an extra fuel quantity, which is supplied to the diesel internal combustion engine during the latter portion of the first phase and in the second phase. In the third phase a steady state level is maintained. This improvement is expressed, in particular, in shorter acceleration times, even from low engine speeds.

It is advantageous, furthermore, that no accessories are required in order to carry out the method according to the invention and it can therefore be carried out in a simple way.

In diesel engines, the combustion-space temperature depends on the load state of the engine. Consequently, at low load, such as, for example, during idling, the combustion-space walls are relatively cold. The time-limited extra quantity is possible only because the combustion-space walls of the diesel internal combustion engine are cold under low load. If the combustion-space walls were warm or hot, as they are when the engine is in the highly loaded state, the extra quantity would cause the critical temperature of the combustion-space walls to be exceeded. The method according to the invention is therefore used solely for acceleration from a no-load or low-load state or in a transient mode.

Other objects, advantages and novel features of the present invention will become apparent from the following detailed description of the invention when considered in conjunction with the accompanying drawings.

Figure 1:
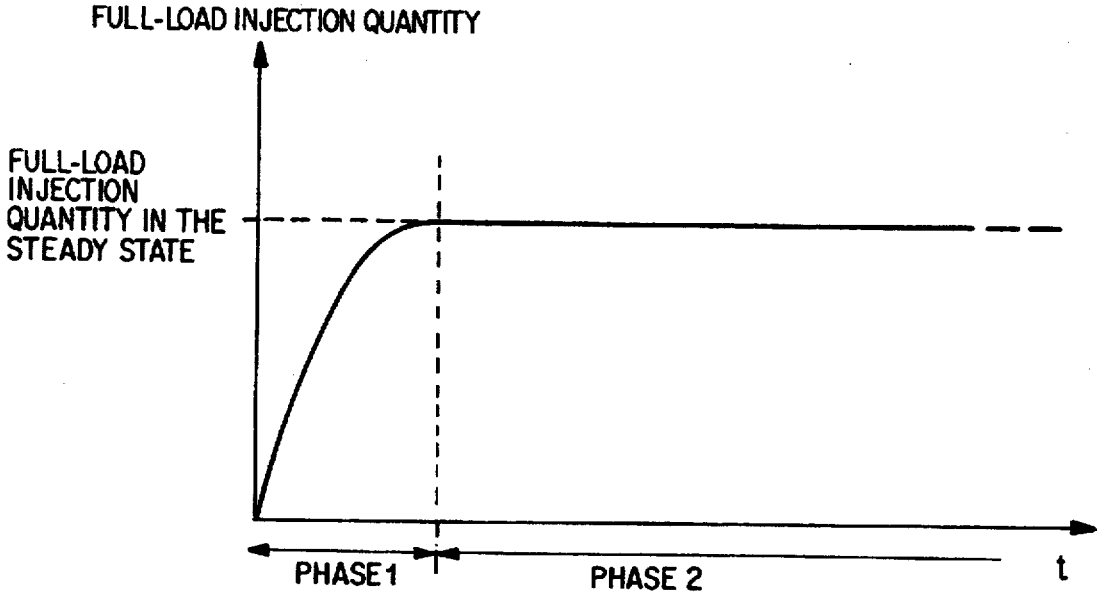
FIG. 1 PRIOR ART
FIG. 1 shows a graph of the full-load injection quantity over time in diesel engines according to the prior art.

DETAILED DESCRIPTION OF THE DRAWINGS:

FIG. 1 shows a graph, in which time t is represented on the abscissa, and the full-load injection quantity supplied to a diesel internal combustion engine is shown on the ordinate. The profile shown there for the full-load injection quantity represents the prior art in the case of diesel engines or supercharged diesel engines. The method is accordingly divided into two phases. In a first time-limited phase the full-load injection quantity is limited as a function of the charge pressure or by means of a smoke characteristic map. This smoke characteristic map is calculated as a function of the engine speed and of the air mass per work cycle calculated from the charge pressure and the charge temperature. As shown in FIG. 1, the full-load injection quantity increases during phase 1 to a steady state value at which the engine, when running continuously, just reaches the limit of mechanical load. After the steady state level has been reached, the method goes over to phase 2, in which the steady-state full-load injection quantity is maintained.

Figure 2:
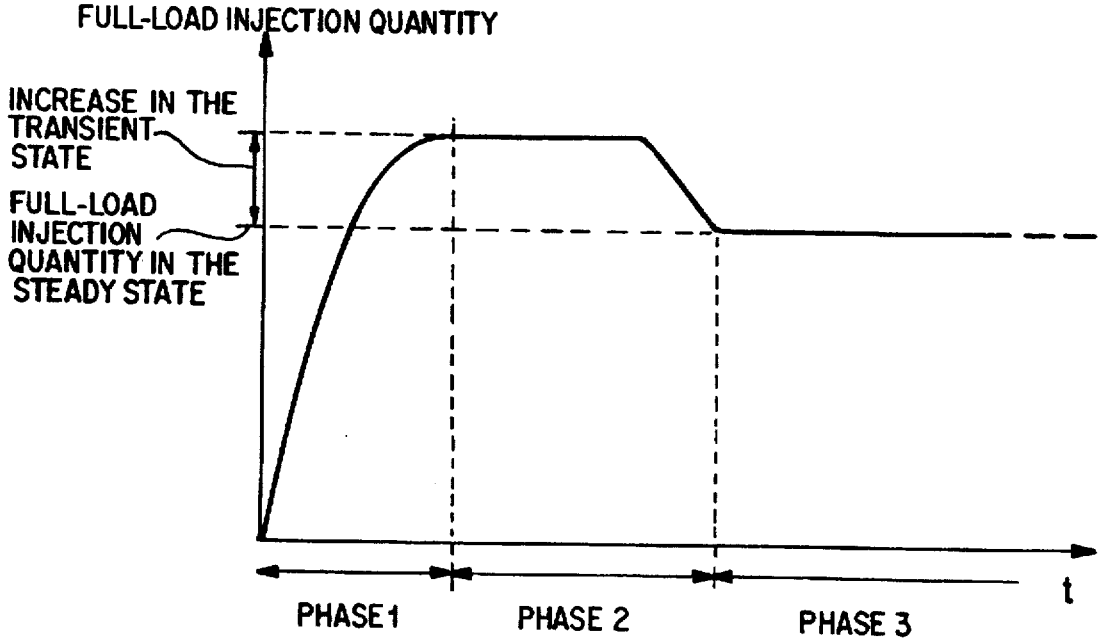
FIG. 2 shows a graph of the full-load injection quantity over time in the method according to the invention.

In FIG. 2, the full-load injection quantity is plotted against time for the method according to the invention, in a manner similar to that of FIG. 1. In this case, the time profile is divided into three phases. In the first transient phase the maximum full-load injection quantity is increased to a value which is greater than the steady state level. In phase 2, an extra quantity is supplied to the diesel internal combustion engine for a limited time. At the end of this phase, the full-load injection quantity is reduced to the steady state level, as already described in FIG. 1. Phase 3 in FIG. 2 corresponds to phase 2 in FIG. 1, with the constant full-load injection quantity in the steady state.

Figure 3:
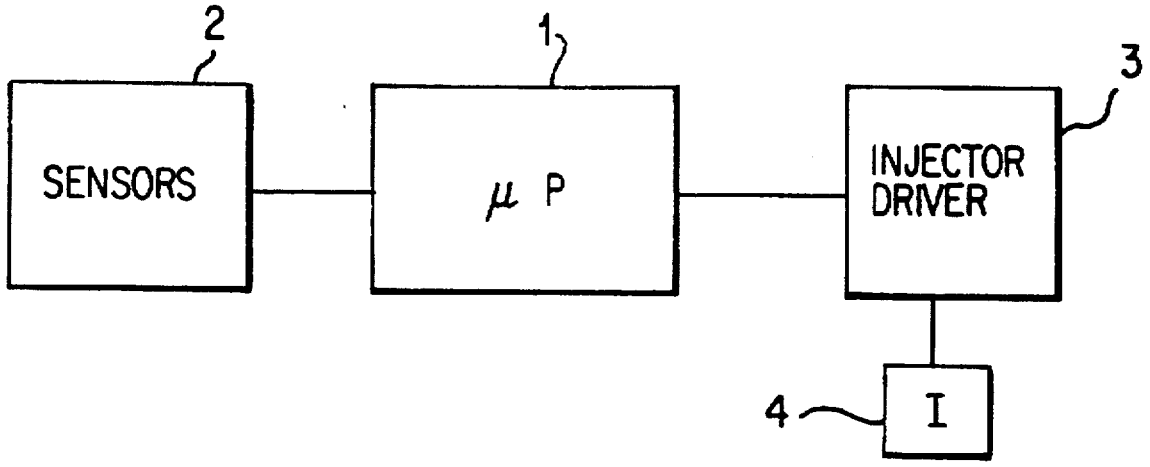
FIG. 3 is a block diagram which shows an arrangement for implementing the method according to the invention.

The increase of the full-load injection quantity as shown in FIG. 2 is regulated by means of a control unit, such as a microprocessor 1 which is otherwise presenton the vehicle. (See FIG. 3.) The control unit 1 detects the presence of a transient state in a conventional manner, based on various internal computing variables, such as, for example, engine speed gradients or load gradients, detected by sensors 2, when the sensed quantities reach or exceed preset levels. The microprocessor then controls the fuel injector driver 3, causing the fuel input from injectors 4 to be regulated as shown in FIG. 2.

Due to the increase of the full-load injection quantity in the transient state, thereby increasing the torque of the diesel internal combustion engine, and reducing acceleration times, in particular during acceleration from low-load states.

What is claimed:

1. Method for regulating the full-load injection quantity of a diesel internal combustion engine having a fixed steady state full-load injection quantity, comprising:

during a first transient phase, increasing the full-load injection quantity to a level which exceeds a steady state value of the full-load injection quantity by an additional amount;

during a second time-limited phase, maintaining the full-load injection quantity at the level which exceeds the steady state value;

during a latter portion of the second phase, reducing the full-load injection quantity to the steady state value; and during a third phase, supplying the steady state full-load injection quantity to the diesel internal combustion engine.

2. Method according to claim 1, wherein the phases are regulated by a regulating unit with the aid of internal computing variables of the diesel internal combustion engine.

* * * * *